US008127798B2

(12) United States Patent
Yoskowitz

(10) Patent No.: US 8,127,798 B2
(45) Date of Patent: Mar. 6, 2012

(54) TURNING VANE FOR AIR DUCT

(75) Inventor: David Yoskowitz, Bloomsbury, NJ (US)

(73) Assignee: Capital Hardware Supply Co., Inc., Closter, NJ (US)

( * ) Notice: Subject to any disclaimer, the term of this patent is extended or adjusted under 35 U.S.C. 154(b) by 428 days.

(21) Appl. No.: 12/459,762

(22) Filed: Jul. 7, 2009

(65) Prior Publication Data

US 2010/0154911 A1 Jun. 24, 2010

Related U.S. Application Data

(60) Provisional application No. 61/203,722, filed on Dec. 23, 2008.

(51) Int. Cl.
*F15D 1/04* (2006.01)

(52) U.S. Cl. ..... 138/39; 138/37

(58) Field of Classification Search ..... 138/39, 138/37

See application file for complete search history.

(56) References Cited

U.S. PATENT DOCUMENTS

| | | | | |
|---|---|---|---|---|
| 1,996,596 | A * | 4/1935 | Smith, Jr. | 138/39 |
| 2,826,221 | A | 3/1958 | Speiser | |
| 2,861,597 | A | 11/1958 | Gracer | |
| 2,959,195 | A | 11/1960 | Gracer | |
| 3,105,520 | A | 10/1963 | Lorett et al. | |
| 3,310,287 | A | 3/1967 | Clark et al. | |
| 3,381,713 | A | 5/1968 | Jacobsen | |
| 3,405,737 | A | 10/1968 | Harper | |
| 3,494,379 | A | 2/1970 | Hinden | |
| 3,602,262 | A | 8/1971 | Hinden | |
| 4,467,829 | A | 8/1984 | Myers | |
| 4,469,446 | A * | 9/1984 | Goodboy | 366/342 |
| 4,586,540 | A | 5/1986 | DeLord | |
| 4,641,684 | A | 2/1987 | DeLord | |
| 4,911,205 | A | 3/1990 | Myers | |
| 4,995,426 | A | 2/1991 | Hinden | |
| 5,529,092 | A | 6/1996 | Arnoldt | |
| 5,927,339 | A * | 7/1999 | Ellis et al. | 138/39 |
| 6,212,771 | B1 * | 4/2001 | Ellis et al. | 29/889.22 |
| 2006/0199502 | A1 * | 9/2006 | Issagholian-Havai | 454/228 |

* cited by examiner

*Primary Examiner* — James Hook
(74) *Attorney, Agent, or Firm* — Abelman, Frayne & Schwab

(57) ABSTRACT

An air turning vane and rail assembly including a pair of rails, a plurality of tabs having a height distance H, a plurality of air turning vanes, each of the turning vanes including a single sheet of metal that is folded in a U-bend to form elongated generally rectangular upper and lower walls, each wall having opposite end edges, the upper wall in end view defining an arc of a first radius of curvature, and the lower wall in end view defining an arc of second radius of curvature greater than the first radius of curvature, and a plurality of crimp spots spaced apart from each other in the lengthwise direction extending transversely through the marginal portions of the upper and lower walls, each two adjacent crimp spots being spaced apart from each other in the lengthwise direction a distance L which is less than the distance H.

17 Claims, 5 Drawing Sheets

Figure 4:
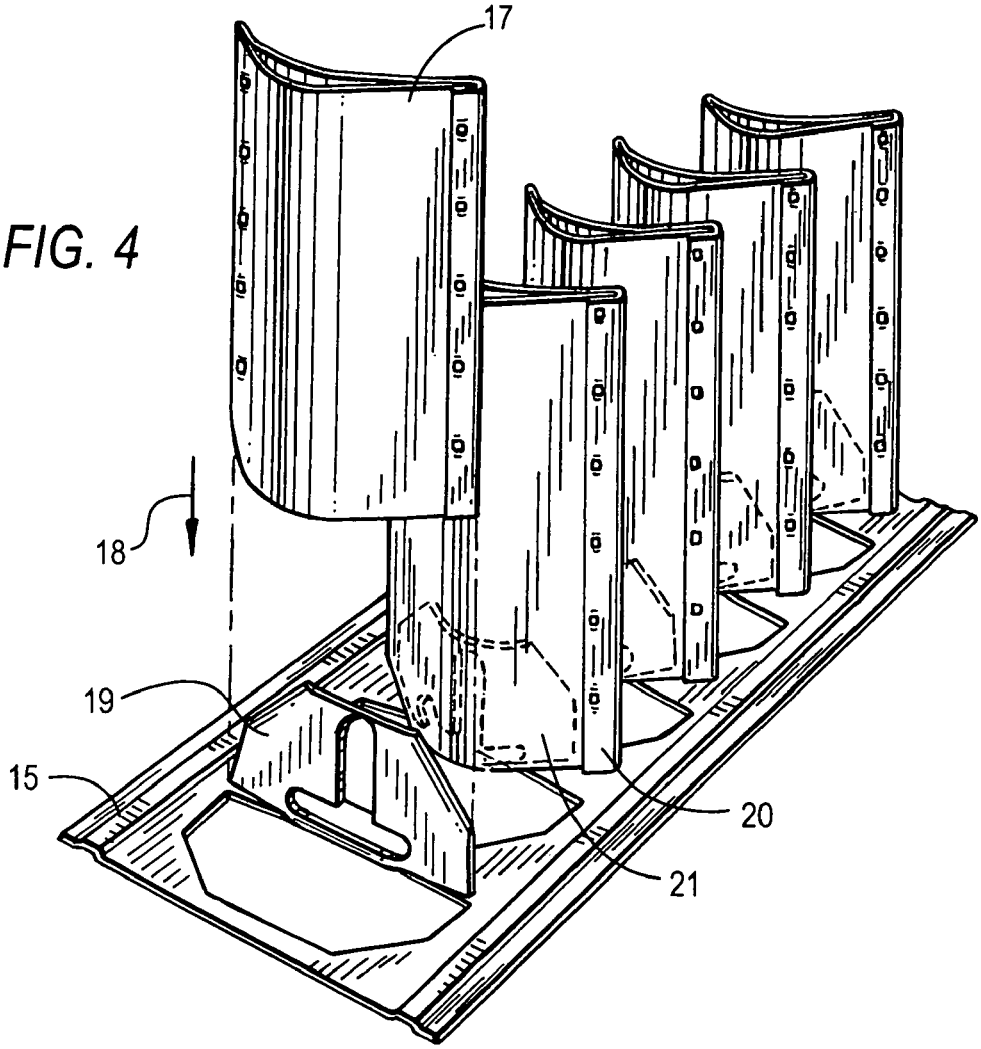

FIG. 1
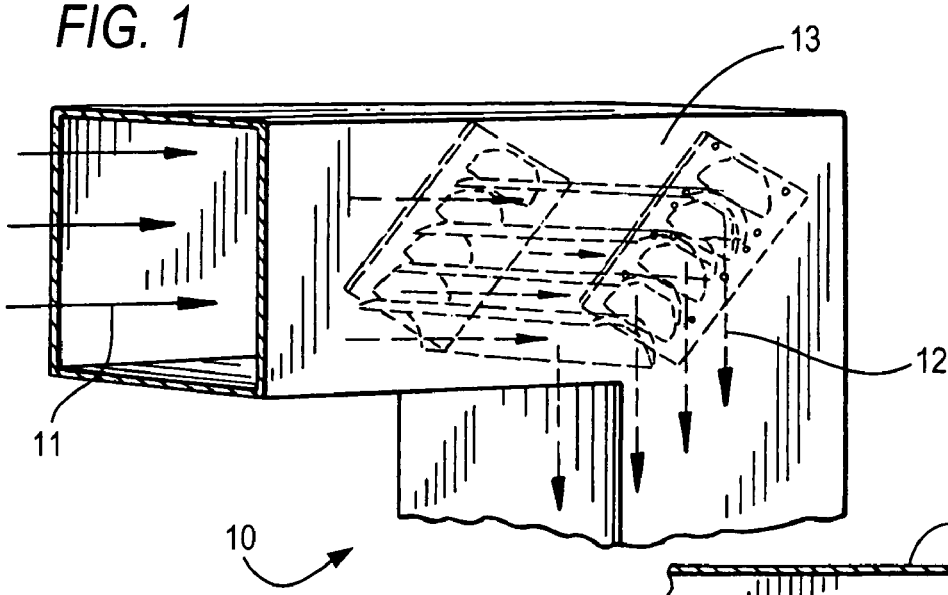
FIG. 2
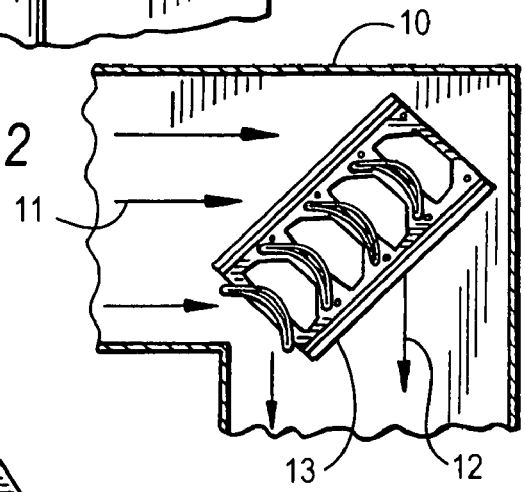
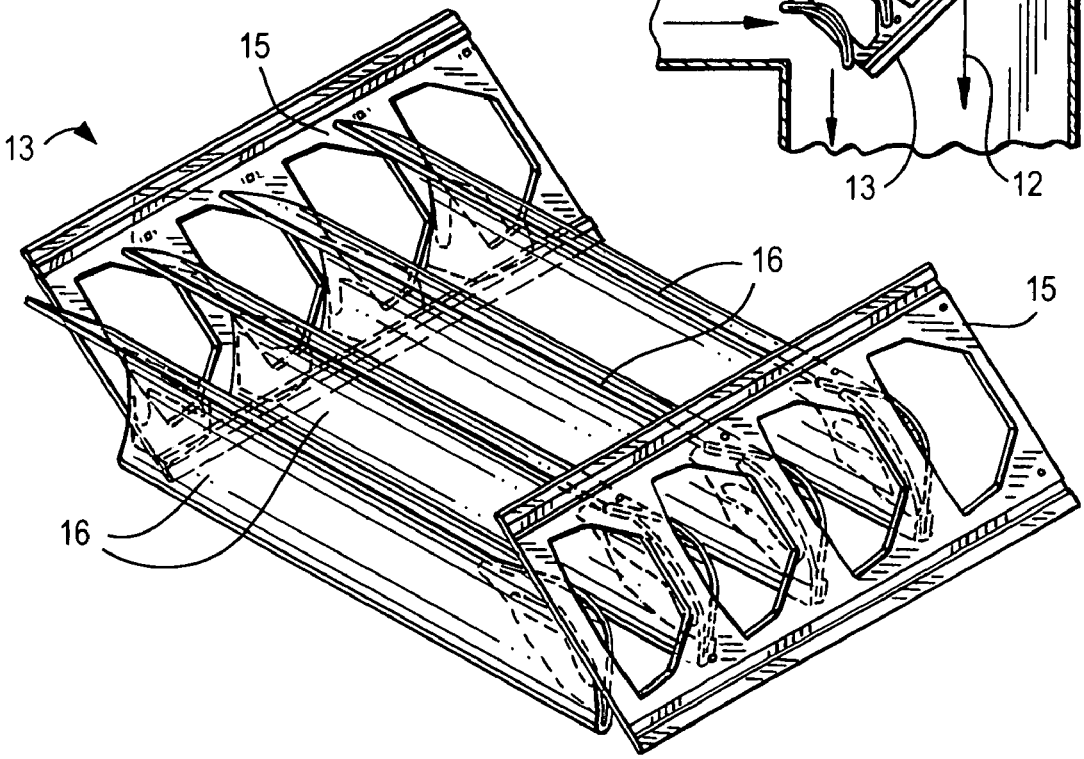
FIG. 3

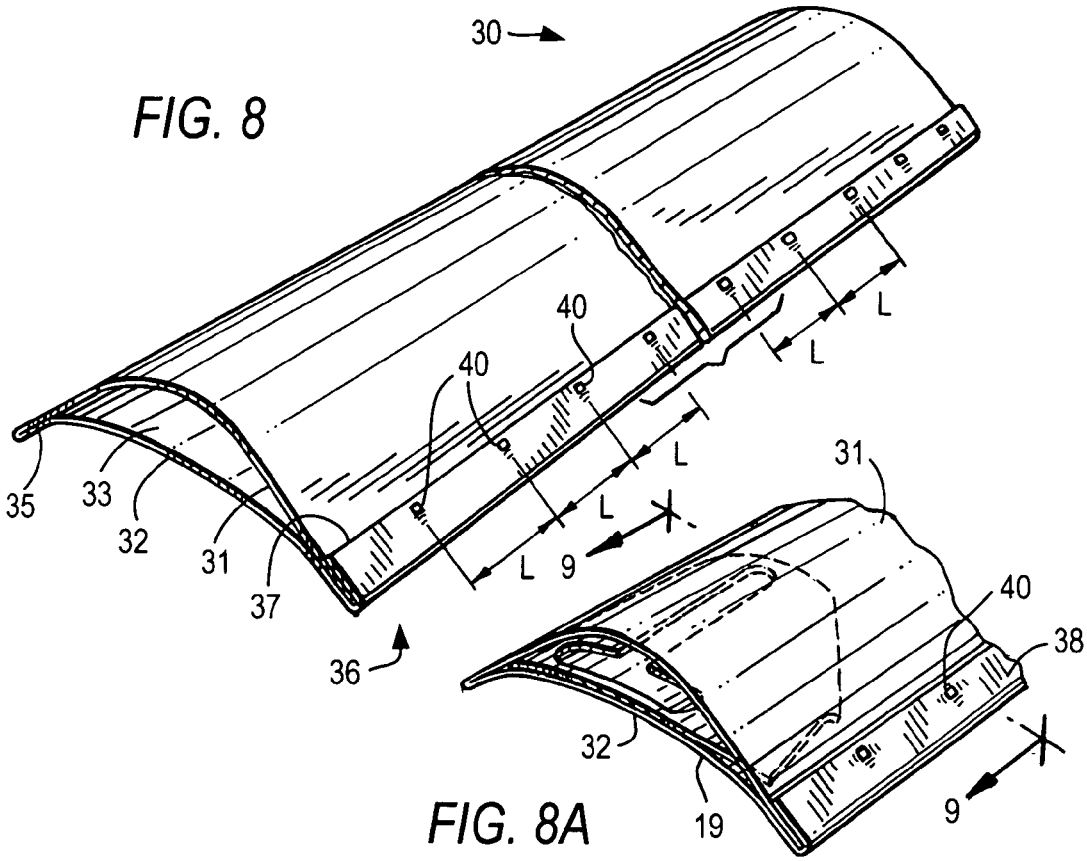
FIG. 8
FIG. 8A
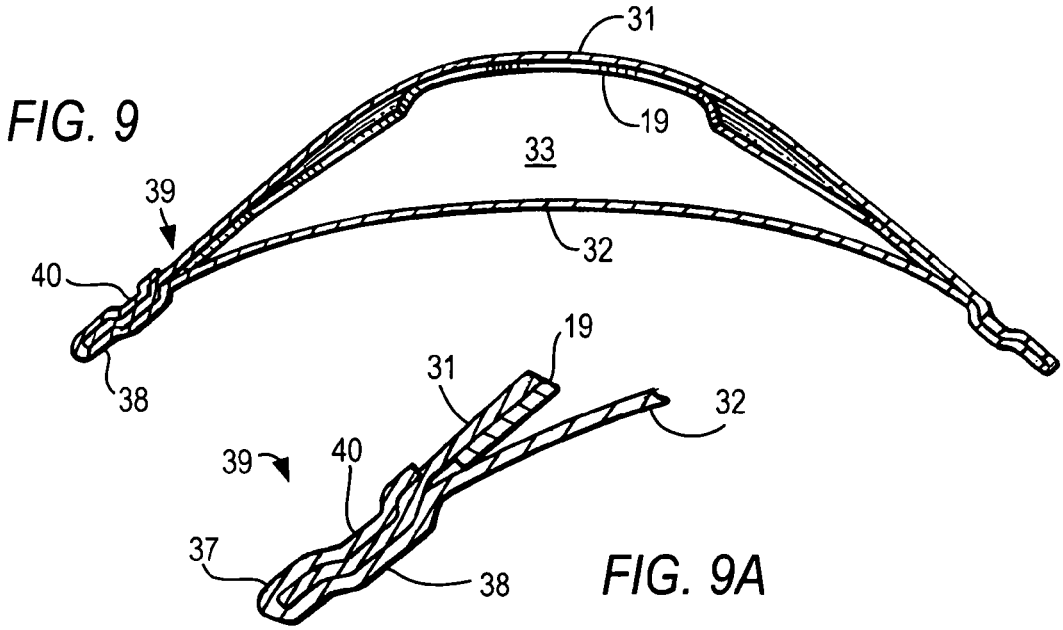
FIG. 9
FIG. 9A

TURNING VANE FOR AIR DUCT

RELATED CASES

This application claims priority under 35 U.S.C. §119,120 and or 365 on Provisional Application Ser. No. 61/203,722 filed Dec. 23, 2008.

I. BACKGROUND

A. Field of the Invention

This invention is directed to air turning vane and rail assemblies utilized in ventilation and air conditioning ducts in commercial, industrial and residential buildings.

B. Background and Prior Art

Turning vane and rail assemblies are positioned within ducts to promote laminar flow of the air within the duct during the directional change of the air as it flows through the duct. Ventilation and air conditioning ductwork used in buildings is typically formed of straight rectangular cross section tubes which may change direction as much as 90 degrees through the use of transition sections or simply by forming the sheet metal ducts in such a manner as to make the turn. If the air flowing through the ductwork becomes turbulent because of the change of direction, there can be a substantial pressure loss and/or undesirable vibration and noise.

Various configurations of the turning vanes have been changed through the years to facilitate the assembly of the turning vanes within the ductwork. Some examples of various configurations of turning vanes and their supporting structures are shown in U.S. Pat. Nos. 2,826,221 3,494,379 2,861,597 3,602,262 2,959,195 4,467,829 3,105,520 4,586,540 3,310,287 4,641,684 3,381,713 4,911,205 3,405,737 and 4,995,426. Even though many configurations of turning vanes and support systems have been devised, there is still a need for an efficient turning vane and rail assembly which may be rapidly, easily and accurately assembled and positioned within an air duct.

C. Objects and Summary of the Invention

A first object is to provide an improved air-turning vane and rail assembly which is both strong and inexpensive, and which is easy to assemble and install and which is sturdy and reliable after installation.

Another object is to provide an air-turning vane for the new assembly wherein the vane is formed of a single sheet of metal folded in a U-shaped turn at one edge and with opposite free ends, one of which is folded over the other as a hem. The new air-turning vane in cross-section defines a crescent with an upper wall of smaller radius of curvature adjacent a lower wall of larger radius of curvature, and a crescent-shaped space defined between the upper and lower walls.

A still further object of the present invention is for this new air-turning vane to be inexpensive and simple in manufacture by utilizing with this single sheet crimp spots or dimples, or other securing means along adjacent edges to secure the upper and lower walls in the desired relative configuration.

An additional object of this invention is to form in the rails tabs punched and bent out of the plane of the rail, for insertion into said crescent-shaped spaces of said vanes, each tab to have a height dimension which is greater than the distance between each two adjacent dimples mentioned above, so that upon engagement or insertion of each tab into said crescent space at the end of each turning vane, the upper and lower walls of the turning vane will be sufficiently well supported to assure strength and stability of the vane at such point of engagement with a tab.

An additional object is to provide on each tab side wings and an internal cut-away area to allow each tab to be easily bent to generally conform to the crescent-shaped opening in the end of a turning vane for said insertion therein.

Preferred embodiments of the present invention include: (a) an assembled air-turning apparatus in ladder-like form comprising a set of parallel rails with perpendicularly intersecting air-turning vanes spaced apart and parallel to each other, (b) an assembly of rails and air-turning vanes that are joinable into an air-turning apparatus in ladder-like form which may be assembled either within an air duct or independently of such air duct, and (c) an individual air-turning vane for attachment between a set of rails, where, in each case above the air-turning vane is formed of a single sheet of metal or other suitable material folded in a U-bend to establish upper and lower curved walls, with remote edges of said upper and lower walls closely adjacent and crimped or otherwise secured together with a folded-over hem, and said edges forming said U-bend similarly secured with crimp spots and each two adjacent crimp spots being spaced apart from each other a distance L that is less than the height H of a tab extending from a rail into the end of such air-turning vane.

Exemplary preferred embodiments are:

(A) An air turning vane and rail assembly for promoting laminar air flow in an angled duct work section, comprising:

a. a pair of rails in parallel spaced apart relation, b. each of said rails having an elongated body part and a plurality of tabs spaced apart from each other punched from and bent to extend generally perpendicular to said body part in a height distance H, and c. a plurality of air turning vanes in parallel and spaced apart relation to each other and situated between and perpendicular to said rails in a ladder-like assembly, each of said vanes having opposite ends, with each of said ends attached to one of said tabs of said rails, d. each of said turning vanes comprising a single sheet of metal that is folded in a U-bend to form elongated generally rectangular upper and lower walls, e. each wall having a main portion extending lengthwise with near side edge marginal portions extending contiguously from said U-bend and opposite remote side edge marginal portions and having opposite end edges, f. said vane defining a lengthwise axis extending between said opposite ends, g. said upper wall in end view defining an arc of first radius of curvature, and h. said lower wall in end view defining an arc of second radius of curvature greater than said first radius of curvature, with a crescent shaped space defined between said upper and lower walls, i. said lower wall remote side marginal portion being closely adjacent, overlying and folded over as a hem onto said upper wall remote side marginal portion, j. said near side edge marginal portions of said upper and lower walls being overlying and closely adjacent, k. a plurality of crimp spots spaced apart from each other in said lengthwise direction for stabilizing said upper and lower walls in said vane configuration, each crimp spot (i) extending transversely through said remote edge marginal portions of said upper and lower walls and said folded over hem, and (ii) extending through said near edge marginal portions of said upper and lower walls, each two adjacent crimp spots being spaced apart from each other in said lengthwise direction a distance L which is less than said distance H, and l. in each of said crescent shaped spaces in ends of said vanes one of said tabs being inserted and bent to generally conform to and fit snugly.

(B) An air turning vane and rail assembly for promoting laminar air flow in an angled duct work section, comprising:

a. a pair of rails positionable in parallel spaced apart relation, b. each of said rails having an elongated body part and a plurality of tabs spaced apart from each other and extending generally perpendicular to said body part in a height distance H, each of said tabs being normally generally planar but bendable, and c. a plurality of air turning vanes adapted to be assembled in parallel and spaced apart relation to each other and to be situated between and perpendicular to said rails in a ladder-like assembly, each of said vanes having opposite ends, with each of said ends releasably attachable to one of said tabs of said rails, d. each of said turning vanes comprising a single sheet of metal that is folded in a U-bend to form elongated generally rectangular upper and lower walls, e. each of said walls having a main portion extending lengthwise with near side edge marginal portions extending contiguously from said U-bend and opposite remote side edge marginal portions and having opposite end edges, f. each of said vanes defining a lengthwise axis extending between said opposite ends, and g. for each of said vanes:

(1) said upper wall in end view defining an arc of first radius of curvature, (2) said lower wall in end view defining an arc of second radius of curvature greater than said first radius of curvature, with a crescent shaped space defined between said upper and lower walls, (3) said lower wall remote side marginal portion being closely adjacent and folded over as a hem onto said upper wall remote side marginal portion, (4) said near side edge marginal portions of said upper and lower walls being overlying and closely adjacent, (5) said remote side edge marginal portions of said upper and lower walls being overlying and closely adjacent, and h. a plurality of crimp spots spaced apart from each other in said lengthwise direction for stabilizing said upper and lower walls in said vane configuration, each crimp spot (i) extending transversely through said remote edge marginal portions of said upper and lower walls and said folded over hem, and (ii) extending through said near edge marginal portions of said upper and lower walls, each two adjacent crimp spots being spaced apart from each other in said lengthwise direction a distance L which is less than said distance H, and i. in each of said crescent shaped spaces in ends of said vanes one of said tabs being insertable and bendable to generally conform to and fit snugly.

(C) An assembly according to claim 1 wherein said main portion of the upper wall of each of said vanes has a smooth uninterrupted external top surface.

(D) An assembly according to claim 1 wherein said main portions of said upper and lower walls have smooth uninterrupted external surfaces respectively.

(E) An assembly according to claim 1 wherein said vane is symmetrical about said lengthwise axis.

(F) An assembly according to claim 1 wherein said crescent-shaped space is symmetrical about said lengthwise axis.

These and other objects of the present invention will becomes apparent as this description proceeds in conjunction with the following specification and appended claims.

II. BRIEF DESCRIPTION OF THE DRAWINGS

Figure 7:
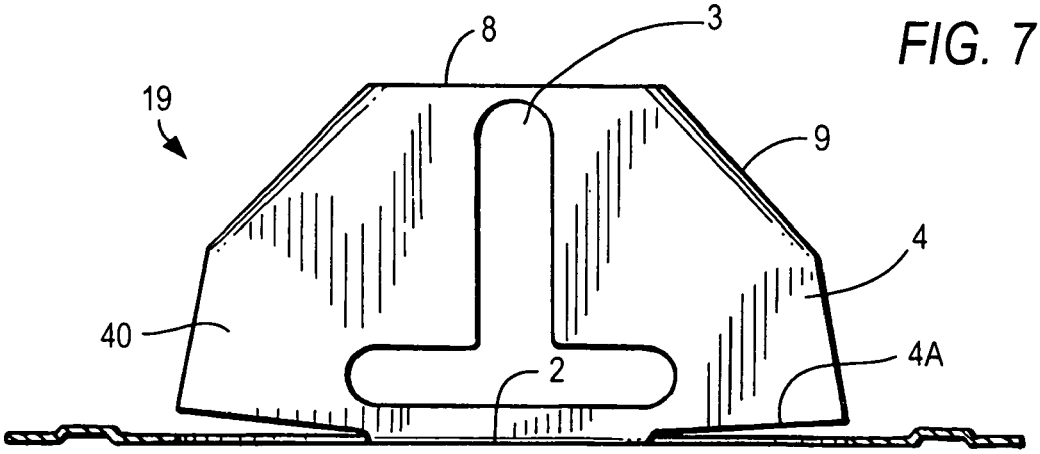
Figure 5:
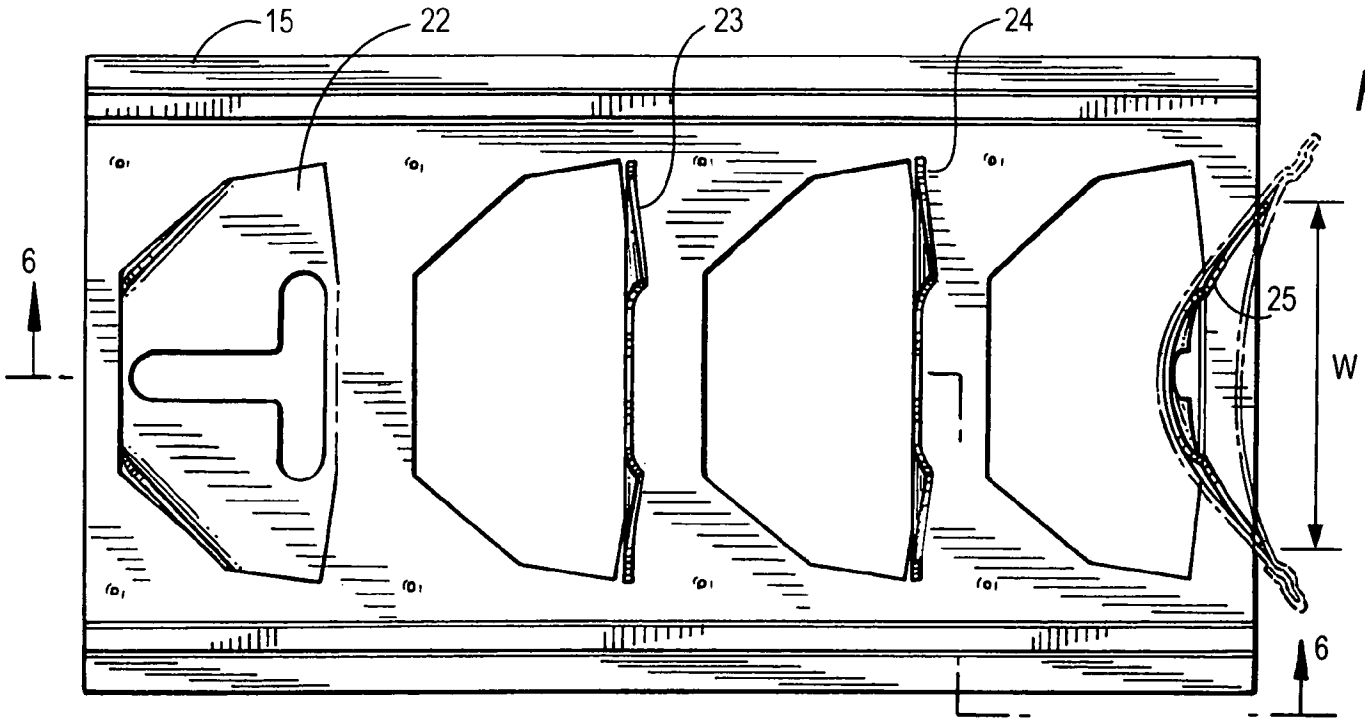
Figure 6:
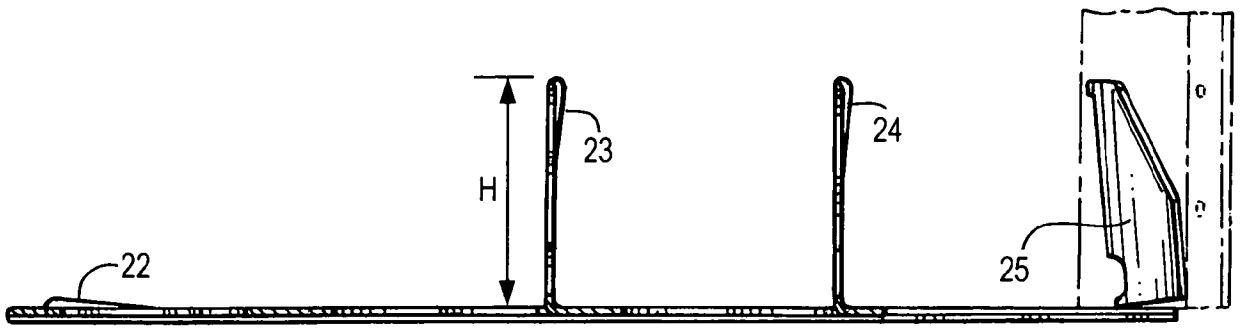
Figure 10C:
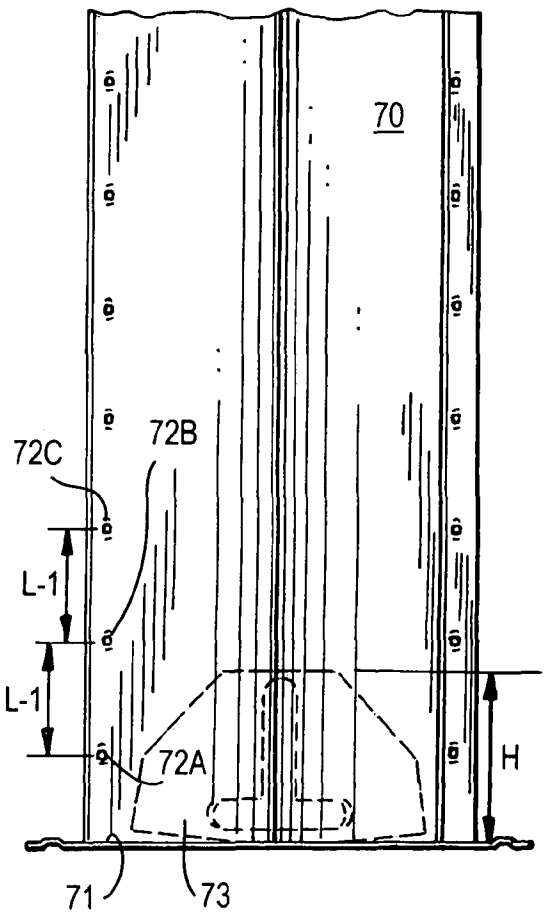
Figure 10B:
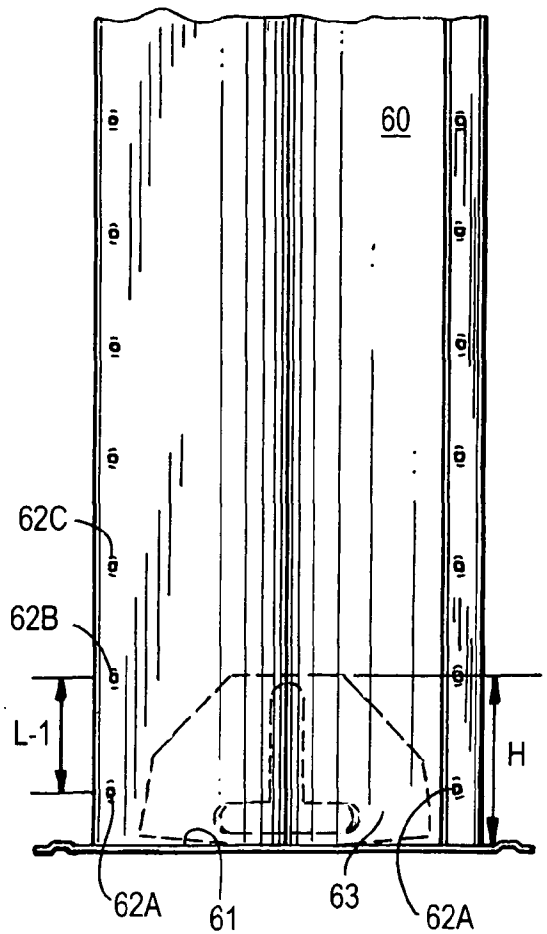
Figure 10A:
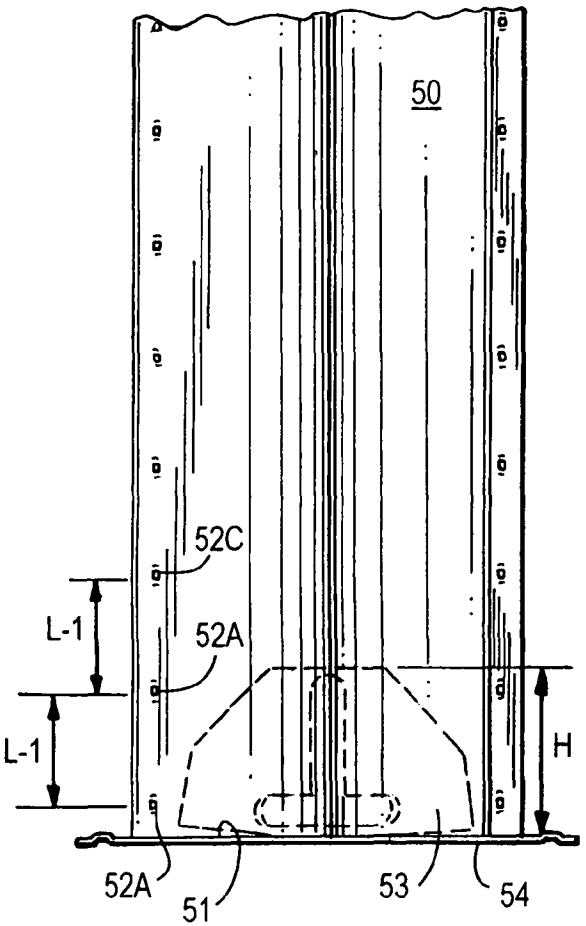

FIG. 1 is a perspective view of the air-turning vane and rail assembly of the present invention installed within a right angle air duct, FIG. 2 is a fragmentary side elevation view in section of the air-turning vane and rail assembly of FIG. 1, FIG. 3 is a perspective view of the air-turning vane and rail assembly alone, FIG. 4 is a perspective view of a partially assembled air duct turning vane and rail assembly with vanes of dual arch crescent cross-section shown in stages of assembly with a rail, FIG. 5 is a top plan view of the rail element alone with tabs in different stages of erection, FIG. 6 is a side elevation view partially in section of the rail element of FIG. 5, FIG. 7 is an end elevation view of the rail element of FIG. 6, FIG. 8 is a top perspective view of the new single-sheet double arch crescent turning vane, FIG. 8A is a fragmentary perspective view of the air-turning vane of FIG. 8 with a tab inserted in its near end, FIG. 9 is an elevation view in section taken along line 9-9 in FIG. 8A, FIG. 9A is an enlarged view in section of one side edge of said vane, FIG. 10A is an end elevation view of a rail and the end of one vane attached to a tab of the rail, where the tab height is greater than the distance between two adjacent crimp spots on the vane, FIG. 10B is similar to FIG. 10A with the end of the vane cut off at a different location farther away from the nearest crimp spot, but with the tab height still being greater than the distance between any two adjacent crimp spots, and FIG. 10C is similar to FIGS. 10A and 10B, with the end of the vane cut off at a location still further from the nearest crimp spot, but with the tab height still corresponding to and overlying at least one crimp spot.

III. DETAILED DESCRIPTION OF THE PREFERRED EMBODIMENT

FIGS. 1 and 2 illustrate a typical air duct 10 which includes a right angle turn, thus requiring air flow 11 to make a 90° turn to continue as air flow 12. Turning is efficiently achieved through turning vane assembly 13, as further described below.

FIG. 3 shows a fragmentary view of the turning vane and rail assembly 13 comprising spaced apart rails 15 to which are attached turning vanes 16.

Attachment of each turning vane 16 to one rail 15 is illustrated in FIG. 4, where vane 17 is moved in the direction of arrow 18 toward upward-extending tab 19 which is punched and bent 90° out of the plane of rail 15. Also in FIG. 4 is shown an adjacent vane 20 descending downward on its corresponding tab 21 and secured thereto.

FIGS. 5, 6 and 7 are top, side elevation and end elevation views respectively of one rail 15 with tabs 22, 23, 24 and 25. As seen in FIGS. 5 and 6, tab 22 is in its initial punched but not-bent state, tabs 23 and 24 are bent into their erect position to height H above the plane of rail 15, and tab 25 is erect and shown in the curved state it will later acquire when inserted into the end of a vane.

FIG. 7 further illustrates in a single tab 19 side wings 4, from which extends a narrowing upper part with partially rolled over top edges 9 which allow this upper portion of the tab to more easily become inserted into the crescent shaped space in the open end of a vane. Also shown in FIG. 7 is the inverted T-shape cut-out 3 and angled cut 4A which allow the tab to be readily bent upward and later curved upon insertion into a vane end.

FIG. 5 illustrates the width W of each tab which will be described later with regard to its insertion into the hollow crescent space within a turning vane.

FIG. 8 shows a perspective view of the new turning vane 30 which is formed by a single sheet of metal to establish a top or upper wall 31 and lower wall 32. Wall 31 has a radius of curvature and higher elevation than lower wall 32 with its larger radius of curvature and a lower elevation. A crescent space 33 is established between said upper and lower walls. The single sheet is folded to form a first bent edge 35 seen in FIG. 9 and FIG. 8, and an opposite vane edge 36 formed by top wall edge 37 and bottom wall edge 38 which are closely adjacent. Bottom edge 38 is folded over to overlie top wall edge 37 as a hem 39. This laminate of three layers is joined by crimping as dimples 40 spaced along the length of each side edge seam. The longitudinal spacing L between each two adjacent dimples, as seen in FIG. 8, is established as a dimension that is less than the height dimension H of each tab as seen in FIG. 6.

A feature of the present invention is the relationship of (a) the spaced-apart distance L between adjacent dimples 40 or other forms of crimping, welding or securing the opposite edges of the turning vane to (b) the height H of tabs of the rail which are installed into the crescent and opening of each vane attached to the rail. Engagement of the new vane with a tab will always be sturdy and secure, because a tab, having height greater than a distance between two dimples, will always extend to be adjacent at least one crimp spot, regardless of the location where the vane is cut along its length for any particular assembly with a set of rails. In practice in the assembly and installation of turning vane assemblies, it is common for the installers to cut vanes to specific lengths as the situations dictate. Since situations in the field are not totally predictable, it cannot be known in advance where each cut will lie relative to the dimples or other attachment points. However, with the new turning vane assembly as disclosed herein, it will not matter where the cut point is along the length of a turning vane, because at any cut point the distance remaining between the next two adjacent dimples will be less than the height of the tab that is going to be installed in the direction of those dimples.

FIG. 10A shows a vane 50 with a cut end 51 and crimp points 52*a*, 52*b*, 52*c* visible at intervals L−1. In this figure a tab 53, extending at 90° from rail 54, has been inserted into the crescent space between the top and bottom walls of end 51 of vane 50. As seen, tab 53 has height H which is greater than length L−1 between crimp spots 52*a* and 52*b* or between any two crimp spots, and according to this invention tab 53 has height H greater than the distance L−1 between crimp spots 52*a* and 52*b* or between any two adjacent crimp spots. Thus, vane 50 at its end 51 connected to tab 53, has its own top and bottom walls 31, 33 secured in the area of tab 53 by its crimp spots 52*a* and 52*b*. Walls 31 and 33 engage tab 53 tightly and the at least one crimp spot adjacent tab 53 assures that these walls will remain secured tightly together to sustain their gripping engagement of the tab. This stabilizes and assures sufficient strength and rigidity of the assembly.

FIG. 10B illustrates a different vane 60 with its end 61*a* greater distance from the nearest crimp spot 62*a*, than the distance in FIG. 10A. Tab 63 extends into the end 61 of vane 60 a distance H which lays adjacent crimp spots 62*a* and 62*b*, height H being greater than distance L−1.

FIG. 10*c* illustrates a still different vane 70 whose tab 73 of the same height H, extends into end 71 of vane 70, where it is adjacent only one crimp spot 72*a*; however, because of the relationship of L−1 (interval between crimp spots) being less than H (height of tab), said tab will always be adjacent at least one crimp spot. Thus, with any of the exemplary sets of vane and rail structures, it is always assured that the vane will be securely and stably engaged to a tab.

In FIG. 7 tab 29 is seen to have a base part 2, an inverted T-shape cut-out 3, wings 4, top edge 8 and rolled-over level edge 9. When a tab is inserted into the crescent opening 33 of vane 30 (see FIGS. 4, 8, 9, 10A), rolled-over bevel edges 9 readily slide into the opening, wings 4 deflect to generally conform to the available space in the crescent opening, bendingly facilitated by cutout 3 which creates weakened areas for bending to occur while adequate strength of tab 19 is maintained. FIG. 9 shows more clearly how wings 4 fit snugly into the tapered crevice 4A at each end of the crescent opening.

With the rail and vane as disclosed herein, assembly in the field or in a factory or elsewhere is readily done without special tools or special assembly procedures and still produces secure, stable and reliable junctions.

As result of the new design and construction of the new turning vane and rail assembly, fitting, cutting and assembly in the field will be easier and quicker and more reliable and less expensive than has been experienced with prior art turning vane assemblies. Also, as result of the new design, it is possible to form each turning vane of a single sheet of metal which substantially reduces manufacturing costs by having less components, less inventory and less positioning of parts in assembly. Also the single fold of the sheet on itself to form one of the side edges automatically establishes strength and stability that would otherwise have to be created by positioning and crimping two separate sheets. Furthermore, the single sheet formation of this turning vane facilitates the formation of the double archs of larger and smaller radii of curvature and the internal crescent shape between the top and bottom walls, and improved overall stability of this vane structure. As result of this new turning vane used in combination with the rail components, (a) assembly in the field can be done more efficiently and more quickly, (b) the resulting structures are more reliable and stable, and (c) assembly in the field can be done without need of special tooling or crimping on site.

While the preferred embodiment of the present invention has been shown and described above, it should be understood that within the scope of the appended claims, the invention may be practiced in other forms specifically shown herein.

The invention claimed is:

1. An air turning vane and rail assembly for promoting laminar air flow in an angled duct work section, comprising:

a. a pair of rails in parallel spaced apart relation, b. each of said rails having an elongated body part and a plurality of tabs spaced apart from each other punched from and bent to extend generally perpendicular to said body part in a height distance H, and c. a plurality of air turning vanes in parallel and spaced apart relation to each other and situated between and perpendicular to said rails in a ladder-like assembly, each of said vanes having opposite ends, with each of said ends attached to one of said tabs of said rails, d. each of said turning vanes comprising a single sheet of metal that is folded in a U-bend to form elongated generally rectangular upper and lower walls, e. each wall having a main portion extending lengthwise with near side edge marginal portions extending contiguously from said U-bend and opposite remote side edge marginal portions and having opposite end edges, f. said vane defining a lengthwise axis extending between said opposite ends, g. said upper wall in end view defining an arc of first radius of curvature, and h. said lower wall in end view defining an arc of second radius of curvature greater than said first radius of curvature, with a crescent shaped space defined between said upper and lower walls, i. said lower wall remote side marginal portion being closely adjacent, overlying and folded over as a hem onto said upper wall remote side marginal portion, j. said near side edge marginal portions of said upper and lower walls being overlying and closely adjacent, k. a plurality of crimp spots spaced apart from each other in said lengthwise direction for stabilizing said upper and lower walls in said vane configuration, each crimp spot (i) extending transversely through said remote edge marginal portions of said upper and lower walls and said folded over hem, and (ii) extending through said near edge marginal portions of said upper and lower walls, each two adjacent crimp spots being spaced apart from each other in said lengthwise direction a distance L which is less than said distance H, and l. in each of said crescent shaped spaces in ends of said vanes one of said tabs being inserted and bent to generally conform to and fit snugly.

2. An assembly according to claim 1 wherein said main portion of the upper wall of each of said vanes has a smooth uninterrupted external top surface.

3. An assembly according to claim 1 wherein said upper wall of each of said vanes has a smooth uninterrupted top surface except for said hem on said remote side edge marginal portion.

4. An assembly according to claim 1 wherein said main portions of said upper and lower walls have smooth uninterrupted external surfaces respectively.

5. An assembly according to claim 1 wherein said vane is symmetrical about said lengthwise axis.

6. An assembly according to claim 1 wherein said crescent-shaped space is symmetrical about said lengthwise axis.

7. An assembly according to claim 1 wherein said crescent-shaped space is symmetrical about said lengthwise axis.

8. An air turning vane and rail assembly for promoting laminar air flow in an angled duct work section, comprising:

a. a pair of rails positionable in parallel spaced apart relation, b. each of said rails having an elongated body part and a plurality of tabs spaced apart from each other and extending generally perpendicular to said body part in a height distance H, each of said tabs being normally generally planar but bendable, and c. a plurality of air turning vanes adapted to be assembled in parallel and spaced apart relation to each other and to be situated between and perpendicular to said rails in a ladder-like assembly, each of said vanes having opposite ends, with each of said ends releasably attachable to one of said tabs of said rails, d. each of said turning vanes comprising a single sheet of metal that is folded in a U-bend to form elongated generally rectangular upper and lower walls, e. each of said walls having a main portion extending lengthwise with near side edge marginal portions extending contiguously from said U-bend and opposite remote side edge marginal portions and having opposite end edges, f. each of said vanes defining a lengthwise axis extending between said opposite ends, and g. for each of said vanes:

(1) said upper wall in end view defining an arc of first radius of curvature, (2) said lower wall in end view defining an arc of second radius of curvature greater than said first radius of curvature, with a crescent shaped space defined between said upper and lower walls, (3) said lower wall remote side marginal portion being closely adjacent and folded over as a hem onto said upper wall remote side marginal portion, (4) said near side edge marginal portions of said upper and lower walls being overlying and closely adjacent, (5) said remote side edge marginal portions of said upper and lower walls being overlying and closely adjacent, and h. a plurality of crimp spots spaced apart from each other in said lengthwise direction for stabilizing said upper and lower walls in said vane configuration, each crimp spot (i) extending transversely through said remote edge marginal portions of said upper and lower walls and said folded over hem, and (ii) extending through said near edge marginal portions of said upper and lower walls, each two adjacent crimp spots being spaced apart from each other in said lengthwise direction a distance L which is less than said distance H, and i. in each of said crescent shaped spaces in ends of said vanes one of said tabs being insertable and bendable to generally conform to and fit snugly.

9. An assembly according to claim 8 wherein said sheet metal has generally uniform thickness.

10. An assembly according to claim 8 wherein said main portion of the upper wall of each of said vanes has a smooth uninterrupted external top surface.

11. An assembly according to claim 8 wherein said upper wall of each of said vanes has a smooth uninterrupted top surface except for said hem on said remote side edge marginal portion.

12. An assembly according to claim 8 wherein said main portions of said upper and lower walls have smooth uninterrupted external surfaces respectively.

13. An assembly according to claim 8 wherein said vane is symmetrical about said lengthwise axis.

14. An assembly according to claim 8 wherein said sheet metal has generally uniform thickness.

15. A kit for an air turning vane and rail assembly for promoting laminar air flow in an angled duct work section, comprising: An air turning vane and rail assembly for promoting laminar air flow in an angled duct work section, comprising:

a. a pair of rails in parallel spaced apart relation, b. each of said rails having an elongated body part and a plurality of tabs spaced apart from each other and extending generally perpendicular to said body part in a height distance H, each of said tabs being normally generally planar but bendable, and c. a plurality of air turning vanes adapted to be assembled in parallel and spaced apart relation to each other and situated between and perpendicular to said rails in a ladder-like assembly, each of said vanes having opposite ends, with each of said ends attachable to one of said tabs of said rails, d. each of said turning vanes comprising a single sheet of metal that is folded in a U-bend to form elongated generally rectangular upper and lower walls, e. each of said walls having a main portion extending lengthwise with near side edge marginal portions extending contiguously from said U-bend and opposite remote side edge marginal portions and having opposite end edges, f. each of said vanes defining a lengthwise axis extending between said opposite ends, g. for each of said vanes:

(1) said upper wall in end view defining an arc of first radius of curvature, (2) said lower wall in end view defining an arc of second radius of curvature greater than said first radius of curvature, with a crescent shaped space defined between said upper and lower walls, (3) said lower wall remote side marginal portion being closely adjacent, overlying and folded over as a hem onto said upper wall remote side marginal portion, (4) said near side edge marginal portions of said upper and lower walls being overlying and closely adjacent, and h. a plurality of crimp spots spaced apart from each other in said lengthwise direction for stabilizing said upper and lower walls in said vane configuration, each crimp spot (i) extending transversely through said remote edge marginal portions of said upper and lower walls and said folded over hem, and (ii) extending through said near edge marginal portions of said upper and lower walls, each two adjacent crimp spots being spaced apart from each other in said lengthwise direction a distance L which is less than said distance H, and i. in each of said crescent shaped spaces in ends of said vanes one of said tabs being releasably insertable and bendable to generally conform to and fit snugly.

16. An air turning vane and rail assembly for promoting laminar air flow in an angled duct work section, comprising:

a. a pair of rails in parallel spaced apart relation, b. each of said rails having an elongated body part and a plurality of tabs spaced apart from each other punched from and bent to extend generally perpendicular to said body part in a height distance H, and c. a plurality of air turning vanes in parallel and spaced apart relation to each other and situated between and perpendicular to said rails in a ladder-like assembly, d. each of said turning vanes comprising a single sheet of metal that is folded in a U-bend to form elongated generally rectangular upper and lower walls, e. each wall having opposite end edges, f. said vane defining a lengthwise axis extending between said opposite ends, g. said upper wall in end view defining an arc of first radius of curvature, and h. said lower wall in end view defining an arc of second radius of curvature greater than said first radius of curvature, with a crescent shaped space defined between said upper and lower walls, and i. a plurality of crimp spots spaced apart from each other in said lengthwise direction for stabilizing said upper and lower walls in said vane configuration, each crimp spot (i) extending transversely through said marginal portions of said upper and lower walls, each two adjacent crimp spots being spaced apart from each other in said lengthwise direction a distance L which is less than said distance H, and j. in each of said crescent shaped spaces in ends of said vanes one of said tabs being inserted and bent to generally conform to and fit snugly.

17. An air turning vane and rail assembly for promoting laminar air flow in an angled duct work section, comprising:

a. a pair of rails in parallel spaced apart relation, b. each of said rails having an elongated body part and a plurality of tabs spaced apart from each other punched from and bent to extend generally perpendicular to said body part in a height distance H, and c. a plurality of air turning vanes in parallel and spaced apart relation to each other and situated between and perpendicular to said rails in a ladder-like assembly, each of said vanes having opposite ends, with each of said ends removably attached to one of said tabs of said rails, d. each of said turning vanes comprising a single sheet of metal that is folded in a U-bend to form elongated generally rectangular upper and lower walls, e. each wall having a main portion extending lengthwise with near side edge marginal portions extending contiguously from said U-bend and opposite remote side edge marginal portions and having opposite end edges, f. said vane defining a lengthwise axis extending between said opposite ends, g. said upper wall in end view defining an arc of first radius of curvature, and h. said lower wall in end view defining an arc of second radius of curvature greater than said first radius of curvature, with a crescent shaped space defined between said upper and lower walls, i. said lower wall remote side marginal portion being closely adjacent, overlying and folded over as a hem onto said upper wall remote side marginal portion, j. said near side edge marginal portions of said upper and lower walls being overlying and closely adjacent, k. a plurality of crimp spots spaced apart from each other in said lengthwise direction for stabilizing said upper and lower walls in said vane configuration, each crimp spot (i) extending transversely through said remote edge marginal portions of said upper and lower walls and said folded over hem, and (ii) extending through said near edge marginal portions of said upper and lower walls, each two adjacent crimp spots being spaced apart from each other in said lengthwise direction a distance L which is less than said distance H, and l. in each of said crescent shaped spaces in ends of said vanes one of said tabs being insertable and bent to generally conform to and fit snugly.

* * * * *